US011134797B2

(12) United States Patent
Goehring

(10) Patent No.: US 11,134,797 B2
(45) Date of Patent: Oct. 5, 2021

(54) SPACE SAVING MANUAL SHELF MANAGEMENT SYSTEM

(71) Applicant: William R. Goehring, Wexford, PA (US)

(72) Inventor: William R. Goehring, Wexford, PA (US)

( * ) Notice: Subject to any disclaimer, the term of this patent is extended or adjusted under 35 U.S.C. 154(b) by 214 days.

(21) Appl. No.: 15/912,492

(22) Filed: Mar. 5, 2018

(65) Prior Publication Data

US 2018/0249848 A1 Sep. 6, 2018

Related U.S. Application Data

(60) Provisional application No. 62/466,548, filed on Mar. 3, 2017.

(51) Int. Cl.

| | |
|---|---|
| ***A47F 1/12*** | (2006.01) |
| ***A47F 5/00*** | (2006.01) |
| *A47B 96/06* | (2006.01) |

(52) U.S. Cl.

CPC ..... *A47F 1/125* (2013.01); *A47F 1/12* (2013.01); *A47F 1/126* (2013.01); *A47F 5/005* (2013.01); *A47F 5/0025* (2013.01); *A47B 96/06* (2013.01)

(58) Field of Classification Search

CPC ..... A47F 5/005; A47F 5/0025; A47F 1/12; A47F 1/125; A47F 1/126

See application file for complete search history.

(56) References Cited

U.S. PATENT DOCUMENTS

| | | | | |
|---|---|---|---|---|
| 1,702,987 A | | 2/1929 | Wilson | |
| 1,703,987 A | | 3/1929 | Butler | |
| 2,079,754 A | * | 5/1937 | Waxgiser | A47F 1/125 211/59.3 |
| 2,098,844 A | | 11/1937 | Waxgiser | |
| 2,652,154 A | | 9/1953 | Stevens | |
| 3,329,280 A | * | 7/1967 | Norris | A47F 1/12 211/134 |
| 4,042,096 A | | 8/1977 | Smith | |
| 4,300,693 A | | 11/1981 | Spamer | |
| 4,830,201 A | | 5/1989 | Breslow | |
| 5,123,546 A | | 6/1992 | Crum | |

(Continued)

FOREIGN PATENT DOCUMENTS

| | | | | |
|---|---|---|---|---|
| WO | WO-2016166147 A1 | * | 10/2016 | A47F 1/126 |
| WO | WO-2017025563 A1 | * | 2/2017 | G09F 11/00 |

*Primary Examiner* — Kimberley S Wright

(74) *Attorney, Agent, or Firm* — Blynn L. Shideler; Krisanne Shideler; BLK Law Group

(57) ABSTRACT

A manual, bottom supporting, shelf allocation and management system allocates shelf space among rows of products and moves products toward the shelf front and includes a plurality of adjacent shelf allocating and managing units. Each unit includes a base adapted to rest on a shelf and to support the at least one row of products, a perpendicular side divider fixedly attached to a side edge of the base, a puller positioned immediately adjacent to the divider and immediately adjacent to a top of the base, and a back-stop attached to the rear of the puller and protruding laterally across the base which is configured, when the puller is drawn forward, to make contact with a rearmost product resting on the base and to push the rearmost product and any other products on the base forward with the forward movement of the puller.

20 Claims, 5 Drawing Sheets

(56) References Cited

U.S. PATENT DOCUMENTS 5,160,051 A 11/1992 Bustos
5,413,229 A * 5/1995 Zuberbuhler ..... A47F 1/12 211/51
5,417,333 A 5/1995 Flum
5,458,248 A 10/1995 Alain
5,542,552 A 8/1996 Yablans et al.
5,613,621 A * 3/1997 Gervasi ..... A47F 1/125 221/279
5,624,042 A 4/1997 Flum et al.
5,634,564 A 6/1997 Spamer et al.
5,992,651 A 11/1999 Shaw et al.
6,082,556 A 7/2000 Primiano et al.
6,155,438 A 12/2000 Close
6,227,386 B1 5/2001 Close
6,357,606 B1 3/2002 Henry
6,375,015 B1 4/2002 Wingate
6,719,151 B2 4/2004 Close
6,923,330 B1 8/2005 Nagel
6,991,116 B2 1/2006 Johnson et al.
7,086,541 B2 8/2006 Robertson
7,124,897 B2 10/2006 Bustos
7,124,898 B2 10/2006 Richter et al.
7,168,579 B2 1/2007 Richter et al.
7,395,938 B2 7/2008 Merit et al.
7,631,771 B2 * 12/2009 Nagel ..... A47F 3/0486 211/59.3
7,792,711 B2 9/2010 Swafford, Jr.
7,854,333 B2 12/2010 Kottke et al.
7,931,156 B2 * 4/2011 Hardy ..... A47F 1/126 211/59.3
8,056,734 B2 11/2011 Menz et al.
8,453,851 B2 6/2013 Ciesick
8,851,303 B2 10/2014 Crawbuck
9,198,527 B2 * 12/2015 Goehring ..... A47F 1/12
9,532,658 B2 * 1/2017 Hardy ..... A47F 1/126
9,788,665 B2 10/2017 Howard et al.
9,907,413 B2 * 3/2018 Goehring ..... A47F 1/125
2003/0141265 A1 7/2003 Jo
2004/0178158 A1 9/2004 Close
2005/0127014 A1 * 6/2005 Richter ..... A47F 1/12 211/59.2
2005/0258113 A1 11/2005 Close et al.
2007/0068885 A1 3/2007 Busto
2007/0075028 A1 * 4/2007 Nagel ..... A47F 3/0486 211/59.2
2007/0158281 A1 7/2007 Hardy
2010/0096345 A1 * 4/2010 Crawbuck ..... A47F 1/125 211/59.3
2011/0147323 A1 6/2011 Sainato et al.
2012/0103922 A1 5/2012 Bird et al.
2012/0204458 A1 8/2012 Goehring
2014/0124463 A1 * 5/2014 Goehring ..... A47F 1/12 211/49.1
2015/0150387 A1 6/2015 Turner et al.
2017/0020302 A1 1/2017 Goehring
2018/0055250 A1 3/2018 Schmidt
2018/0160823 A1 * 6/2018 Graber ..... A47F 1/125

* cited by examiner

FIG. 12
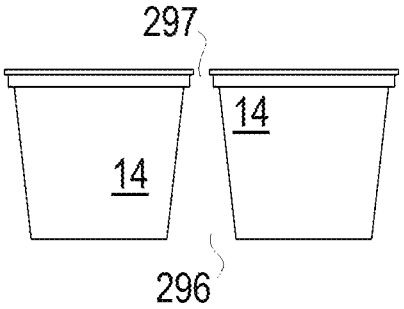
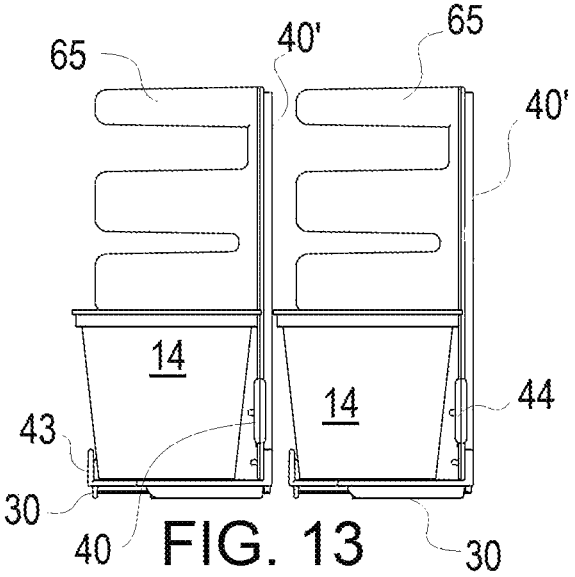
FIG. 13
FIG. 14
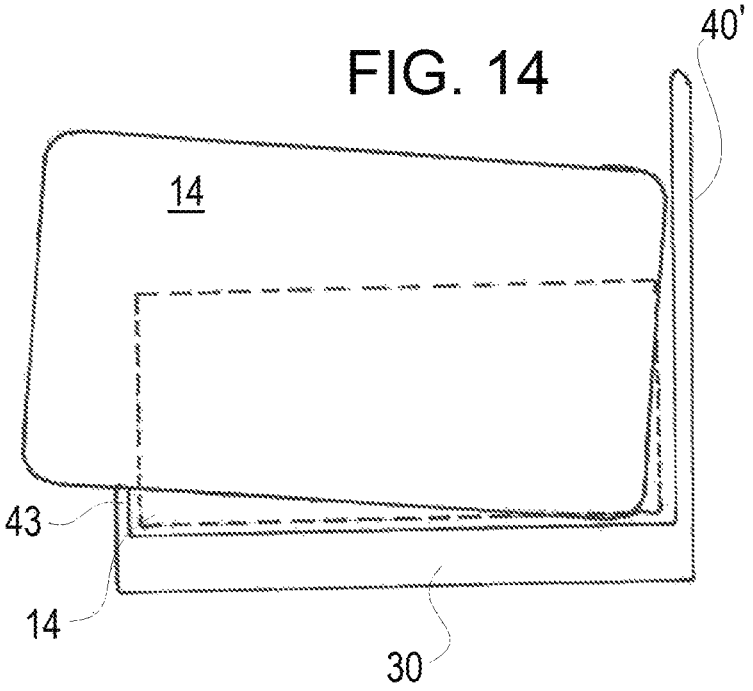

SPACE SAVING MANUAL SHELF MANAGEMENT SYSTEM

RELATED APPLICATIONS

The present application claims the benefit of provisional patent application Ser. No. 62/158,062 filed May 7, 2015 entitled "Space Saving Manual Shelf Management System" which application is incorporated herein by reference.

BACKGROUND OF THE INVENTION

1. Field of the Invention

The present invention relates to manual shelf management systems, and more specifically to a space saving, manual, modular, bottom containing and laterally supporting, shelf management system.

2. Background Information

Labor inefficiencies and other problems result when merchandise is displayed on retail shelves with neither rigid dividers nor a method to bring product forward on the shelf into selling position without handling the merchandise piece-by-piece. These problems pertain to grocery stores and other retail stores where consumer packaged goods, such as food products, spray paint cans and health and beauty care products, are displayed for sale on shelves. With no rigid dividers store personnel must, during product stocking, form rows by approximating straight lines and then finessing products into straight rows. This process is imprecise and time consuming. Further, as new merchandise is fed into rows from the front of the shelf, packages in the middle of the row tend to move to the left or right (known in the art as "snaking") causing packages in the middle or back of the row to be significantly out of alignment with those at the front. This results in wasted labor as store personnel must handle the merchandise multiple extra times to position products in proper row alignment. Another result is shelf disorganization that degrades the shopping experience by making it difficult for shoppers to locate and reach/grasp merchandise. Merchandise is generally always selected by the consumer from the front of the shelf and store personnel are constantly bringing merchandise from the middle and rear of the shelf forward into selling position, a process called fronting. The vast majority of store shelves are fronted using the legacy practice where store clerks grasp individual packages and pull them forward. This manually intensive practice is time consuming and can be counterproductive because, as the store clerk reaches with his hand into the shelf to grasp packages, adjacent merchandise is sometimes knocked out of position which requires the clerk to then re-position that disrupted merchandise before the fronting procedure is completed. Further, the piece-by-piece fronting method is ineffective as typically only one or two items may be easily brought forward into selling position leaving merchandise at the middle and rear of the shelf out of shopper view and inaccessible. Products are occasionally moved to a different location either within the established product area (e.g. moving the row of cherry yogurt from a bottom shelf to a shelf at waist-height) or moved to a different location of the store altogether (e.g. moving the entire yogurt section to a different store aisle), in both cases called "re-sets". Ordinarily all of these so-called shelf conditioning tasks described above require piece-by-piece handling of each individual product. This piece-by-piece handling of products is time consuming, imprecise, creates fatigue for store personnel and may impede the completion of shelf conditioning tasks owing to the time consuming nature of handling products individually. In most grocery stores (and other food stores) yogurt is among the highest selling product, so a comparatively high number of labor hours are required to keep this area stocked and the product fronted. Further, most yogurt containers have a high center of gravity and are therefore easily tipped over. These unstable cups combined with the common practice of stacking yogurt cups 2-high or 3-high (or higher) makes both placing new stock on the shelves and bringing yogurt containers from the rear of the shelf towards the front especially difficult and time-consuming.

The prior art has addressed some of the stocking and fronting problems with various systems. Some of these prior art systems require removal of existing store shelving and replacement with complex and expensive inclined shelves or inclined modules which display one or several product rows. Other prior art systems also require removal of existing shelves and replacement with level modules that incorporate spring pushers that urge the yogurt containers forward through the force of the spring. Still other prior art systems are simple plastic devices designed to be placed on a store's existing flat shelves but either occupy an objectionable amount of shelf space or are cumbersome to operate or both.

U.S. Pat. Nos. 5,417,333, 5,992,651, 7,124,898, 8,056,734, and U.S. Patent Pub. Nos. 2011/0147323, 2012/0103922, and 2015/0150387 disclose shelf management systems that utilize an inclined shelf or inclined module or chute where products (e.g. yogurt containers) are urged towards the front of the shelf or module through force of gravity. These so-called "gravity fed" systems will not operate with existing flat shelves; rather the existing shelving (which the store purchased at considerable expense) is removed and replaced by inclined shelves or modules/chutes. These inclined shelves or modules/chutes are typically very expensive, and this is an additional expense on top of the cost of the discarded original shelving. A time-consuming and therefore costly installation process is required and, if the store wants to move the yogurt section in the future (re-setting the yogurt area), the installation process must be repeated and attendant costs incurred. Further, some of these gravity-fed systems require a time-consuming dis-assembly and re-assembly process when the store changes a product in a given row from a narrow container to a wide one or vice versa.

U.S. Pat. No. 7,631,771 discloses a plastic product supporting tray designed to rest on the existing flat shelf. The tray is comprised of a base corresponding in length to the shelf depth and two side dividers approximately 6.5" in height running the full length of the base. A puller runs through a track positioned on the inside of the right-side divider. A back-stop is attached to the rear of the puller such that, when the puller is drawn forward, the back-stop makes contact with the rearmost product in the row and urges that product and all other products in the row forward. The existence of two tall (6.5") dividers impedes the placement of yogurt containers at the rear of the unit (allowing proper product rotation). Containers can be placed at the rear only by reaching over the two dividers and dropping them into the rear of the unit. A further limitation of this system is that the puller and/or the puller track may become fouled with spilled yogurt or a combination of moisture and dust and this may impede the travel of the puller along the track making puller operation and therefore row fronting difficult and time-consuming.

U.S. Pat. No. 9,788,665 discloses a system comprised of a series of modular trays that are installed in place of the existing flat shelves. Each tray features a base and several dividers. A spring-biased pusher paddle is positioned between each set of dividers. The yogurt containers are placed in front of the pusher paddle and are thereby urged towards the front of the tray. This system requires removal of the store's existing flat shelving (which the store purchased at considerable cost) and replacement with the trays. The installation process is complex and time consuming Because all of the containers in the row are urged forward when a container is removed (thereby eliminating any open space in the row) it can be difficult for a shopper to return a container to the row in the event that she decides not to purchase it. Further, unless the spring is tuned perfectly, the stocking clerk will have to work against the resistance of the spring-biased paddle when placing new yogurt containers in the system.

U.S. Patent Pub. No. 2012/0204458 discloses a combination divider and row fronting mechanism where two dividers extend forward from a back-stop. A divider corresponding in length to the full shelf depth (long divider) rests on the shelf while the other divider is suspended in a cantilevered fashion above the shelf and is only half as long as the shelf depth (short divider). When installed side-by-side this system presents a divider both on the left and the right side of each product row. The front of the long divider may be grasped and drawn forward thereby bringing all of the products in the subject row forward. This system is less effective because the short divider tends to bend out of position during both product stocking and row fronting. When this occurs the clerk must take extra time to place the short divider back into proper position, and this is wasted time which adds to the work of the clerk.

The U.S. Patent Pub. No. 2018/0055250, which is incorporated herein by reference, discloses a plastic product supporting tray designed to rest on an existing flat shelf. The tray is comprised of a base, a tall divider approximately 7.0" in height running the full length of the tray and attached to one side of the base and a very short or low divider approximately 0.30" high running the full length of the tray and attached to the other side of the base. The unit may be adjusted in width to accommodate products of various widths. Protruding from the forward-most point of the top of the tall divider is a hook, and running along the full length of the top of the tall divider is a series of holes. Stocking of new products and row fronting is achieved by removal of the entire tray from the shelf and then lining up the holes running along the top of the tall divider with the hooks protruding from the units remaining on the shelf thereby hanging the subject tray on the trays that remain on the shelf. Thus hung, the subject tray is now positioned so that old stock may be moved to the front by pushing the products towards the front of the tray and new stock may be placed at the rear of the tray. This system is deficient as the only method of fronting a product row is to fully remove the subject tray, hang that tray on the other trays, then manually move the products at the rear of the tray to the front of the tray and then return the subject tray to the shelf. This process is approximately as time consuming as fronting a row with no divider and fronting system, so while this system facilitates proper stock rotation it offers no time advantage in row fronting.

U.S. Pat. No. 9,198,527 (hereinafter the '527 patent), which is incorporated herein by reference, discloses an effective shelf management system for use on retail store shelves, especially on grocery store shelves. The '527 patent also yields an effective description of prior art shelf management solutions that can be helpful in understanding the state of the art. The system of the '527 patent, which is comprised of individual shelf management units, provides effective row separation, provides lateral support for product rows and allows for easy and rapid row fronting. Further, the system disclosed in the '527 patent maintains straight product rows and, along with the above-mentioned features, enhances the shopping experience by facilitating product identification and access. Further, the positive row separation prevents co-mingling of products on the shelves (where an item moves from its designated row into a different adjacent row) which causes extra work for store clerks, leads to difficulty in determining how much of a given item is stocked on the shelf, and can lead to items becoming "lost" on the shelf such that they do not sell before their expiration date. The '527 patent does not attach to the shelf with mechanical fasteners or permanent adhesives making installation fast and easy. Further, because this system is not attached to the shelf, product re-sets are easy to accomplish. As the '527 patent is comprised of individual trays or bases that support individual product rows, re-setting of merchandise is made easier as the units of this system, while loaded with merchandise, can be lifted off and away from the shelf and repositioned on a different shelf location in the store. Further the '527 patent is an easy to manufacture and a low cost system which is a crucial feature for display systems which stores find unattractive if the systems are expensive.

A limitation of the '527 patent is that the divider of a unit may be prevented from being pulled forward for row fronting when a unit is on a retail store shelf with a high front lip. Shelves with a high lip on the top front edge are common in refrigerated sections where, for example, single-serve yogurt cups, tubs of cream cheese and processed meats are displayed for sale. A further limitation of the '527 patent is that the divider and integral back-stop of a unit may be too large and heavy to be easily operated as when the divider and back-stop are drawn forward as during row fronting.

U.S. Patent Pub. No. 2017/0020302 (the '302 publication), which is incorporated herein by reference, addresses some of the limitations of the '527 patent and includes risers, but this solution is not applicable to low vertical clearance applications. The '302 publication discloses a shelf allocating and managing unit with a tall divider (e.g. 7" high) designed to provide lateral support to tall products and/or products that may be stacked 2-high or 3-high or higher (where the top of the product or product stack may be, for example, 7" high). This divider, to which is attached an integral back-stop, is generally the same length as the shelf depth so may be, for example, 22" long. Especially when many product rows need to be fronted in a short amount of time (which is common for a typical store), a divider and back-stop that is approximately 7" high and 22" long is heavy and cumbersome to pull forward and then return to the normal position, and as this divider is heavy and bulky row fronting takes longer than it should and also causes fatigue for store clerks.

It is the object of the present invention to address the deficiencies of the prior art shelf management system and provide a highly effective, very low-cost, easy to install and easy to use shelf management system.

SUMMARY OF THE INVENTION

One aspect of the present invention provides a manual bottom supporting shelf allocation and management system for allocating shelf space among rows of products. The system includes a plurality of adjacent shelf allocating and managing units, each unit associated with at least one row of products. Each unit includes a base adapted to rest on a shelf and to support the at least one row of products, a perpendicular side divider fixedly attached to a side edge of the base; a puller positioned immediately adjacent to the divider and immediately adjacent to a top of the base, and a back-stop attached to the rear of the puller and protruding laterally across the base which is configured, when the puller is drawn forward, to make contact with a rearmost product resting on the base and to push the rearmost product and any other products on the base forward with the forward movement of the puller.

The bottom supporting shelf allocation and management system for allocating shelf space among rows of products according to one aspect of the invention further includes a base that is adjustable in width allowing for one unit to better accommodate a range of products.

The bottom supporting shelf allocation and management system for allocating shelf space among rows of products according to one aspect of the invention further includes a perpendicular low side divider fixedly attached to a side edge of the base extending to a height of 1/10" to 3". A tall divider or divider within the meaning of this specification is a divider at least 4" in height and typically 5-10" in height. A low divider within the meaning of this specification is a divider 1/10" to 3", preferably 2/10" to 8/10" in height, and most preferably 3/10" to 6/10" in height. The low divider can form a product supporting surface for each base whereby select products, namely those wider than the base and thus supported on the product supporting surface of the base, are configured to be inclined in a lateral direction and towards the divider of the shelf management unit. The product supporting surface of each base may further be tapered toward a front of the unit wherein select products supported on the product supporting surface of the base on or in front of the tapered portion are configured to be inclined in a lateral direction and towards the divider of the shelf management unit at less of an incline angle than select products supported on the product supporting surface of the base rearward of the tapered portion.

The bottom supporting shelf allocation and management system for allocating shelf space among rows of products according to one aspect of the invention may further include a laterally protruding ledge on the puller. The ledge may form a stiffening ridge for the puller or further form an element to prevent a non-tipping backstop from tipping back.

The bottom supporting shelf allocation and management system for allocating shelf space among rows of products according to one aspect of the invention may further include wherein the back-stop attached to the rear of the puller and protruding laterally across the base includes a plurality of openings there through. In many refrigerated cases the cooling air moves across the products from the rear of the shelf and a plurality of openings within the back-stop facilitate the cooling of the products and the efficiency of the refrigeration.

The bottom supporting shelf allocation and management system for allocating shelf space among rows of products according to one aspect of the invention may further include wherein the puller is a removable free riding unconstrained puller. A free riding puller within the meaning of this application defines a puller that is not in a defined channel or guideway. The unconstrained puller is easier to manipulate and can be selectably removable. The removability allows the unit, which further includes an open back behind the backstop, to be applicable to rear stocking systems.

The bottom supporting shelf allocation and management system for allocating shelf space among rows of products according to one aspect of the invention may further include wherein the puller includes a rounded handle raised above the base for ease of use.

The bottom supporting shelf allocation and management system for allocating shelf space among rows of products according to one aspect of the invention further includes a non-tipping backstop configured to provide constant support to the rearmost product such that the product is prevented from falling over backwards regardless of the position of the rearmost product on the base.

The bottom supporting shelf allocation and management system for allocating shelf space among rows of products according to one aspect of the invention may provide wherein the side divider includes a tapered forward edge to permit full view of the products.

One aspect of the invention provides a manual bottom supporting and side containing shelf allocation and management unit for allocating shelf space among rows of products and for moving the rows of products towards the front of the shelf. Each unit is associated with at least one, and preferably one, row of products and freely moveable as a unit relative to the shelf. Each shelf allocating and managing unit is comprised of a product supporting base coupled with a tall or high side divider that is connected to the side edge of the base in a fixed width position or alternately in a variety of width positions and where the high side divider provides lateral support to a product or product stack positioned on the base. A puller, corresponding in length to the shelf depth and featuring an integral back-stop, is positioned on top of the base and immediately adjacent to the high divider. The puller and back-stop rest on top of the base and are not constrained or guided by a channel or other connecting mechanism. At least one row of products associated with the unit may be positioned on the shelf on top of the base and immediately adjacent the puller and side divider. The shelf allocating and management unit supports at least one row of products on the base so that the product row may be easily moved when the unit is moved or lifted, and the units combine to provide substantive lateral support on both sides of the products at least when a high side divider of the subject unit is associated with a side divider of an immediately adjacent unit. The back-stop integral to the puller protrudes substantially perpendicularly from the rear of the puller and across the width of the base and is positioned behind the at least one row of products associated with the unit where, when the puller is pulled forward relative to the base, the back-stop may be engaged with the products and may urge them forward in a direction extending between the front and back of the shelf and parallel to the length of the base and substantially perpendicular to the lateral length of the shelf.

BRIEF DESCRIPTION OF THE DRAWINGS

FIG. 12 is a front view of two product packages positioned side-by-side showing the gaps between the packages;

FIG. 13 is a front elevation view showing two shelf allocation and management units holding products and positioned side-by-side; and FIG. 14 is a front elevation simplified schematic view of a shelf allocation and management unit according to one embodiment of the present invention showing a base featuring a fixed side divider that provides lateral containment for a narrower product and an inclined base that urges a wider product in a lateral direction away from the open end of the base;

DESCRIPTION OF THE PREFERRED EMBODIMENTS

Figure 1:
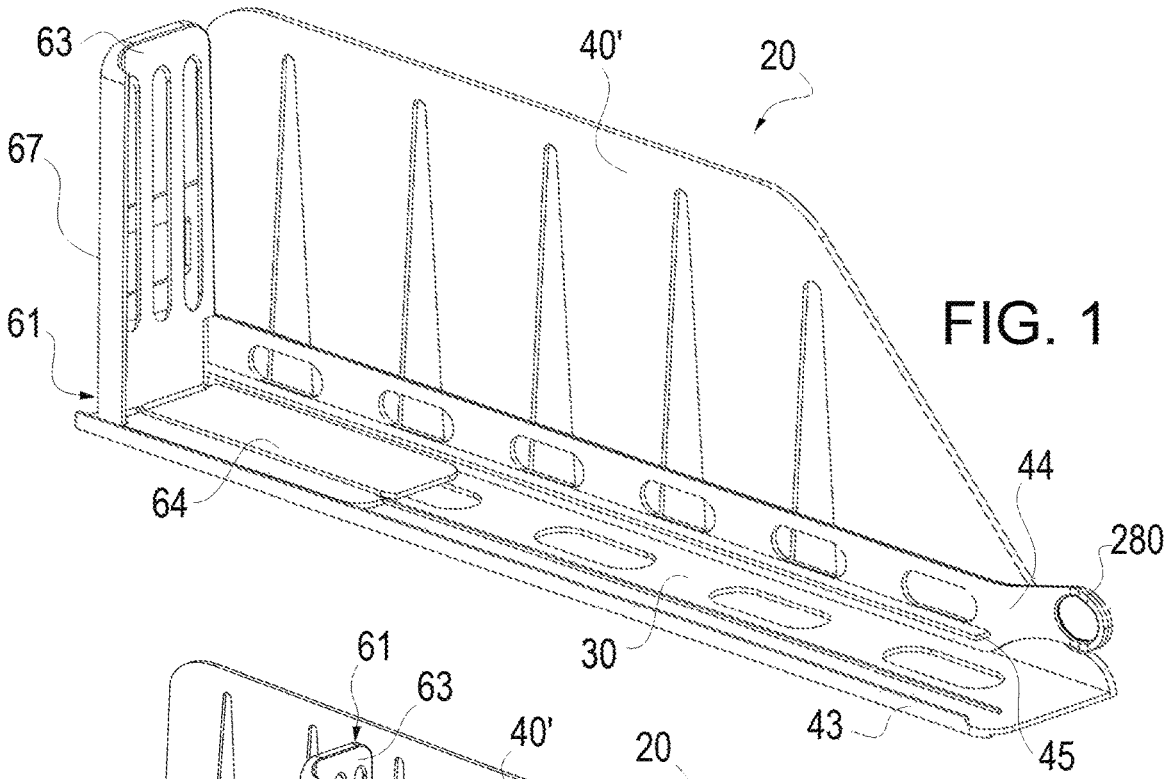
FIG. 1 is a view of a shelf allocation and management unit according to one embodiment of the invention showing a product supporting base attached to a single fixed side divider and a separate puller configured to actuate a non-tipping back-stop.

It is noted that, as used in this specification and the appended claims, the singular forms "a," "an," and "the" include plural referents unless expressly and unequivocally limited to one referent. For the purposes of this specification, unless otherwise indicated, all numbers expressing parameters used in the specification and claims are to be understood as being modified in all instances by the term "about." The terms "about" or "approximate" or similar terms within this application will generally mean within 10% unless otherwise noted. Accordingly, unless indicated to the contrary, the numerical parameters set forth in the following specification and attached claims are approximations that may vary depending upon the desired properties sought to be obtained by the present invention. The various embodiments and examples of the present invention as presented herein are understood to be illustrative of the present invention and not restrictive thereof and are non-limiting with respect to the scope of the invention.

The broad concepts of the operation of the manual shelf management system 10 of the present invention are found in the applicant's prior '527 patent and '302 publication discussed above and incorporated herein by reference. The general construction and operation of a shelf management system 10 is shown schematically in 527 patent and '302 publication. The '527 patent shelf management system 10 includes dividers 40 that provide positive row segregation and lateral support to the products 14 on shelf 12, an integral fronting mechanism via dividers 40 and backstop 60 which allows rapid merchandise fronting, a floating tray design where product 14 rows are positioned on top of the tray or base 30 thereby allowing product 14 rows to be easily repositioned to the left or right or to be moved to another shelf 12 location altogether, and universality in accommodating merchandise 14 of varying widths so that one size of the shelf management system units 20 may be used for a range of different merchandise package widths. A manual shelf management system 10 incorporating all of these features may be referenced herein as a '527 patent type shelf management system 10 and the following disclosure is a variation on the basic features of the '527 type shelf management system.

The present invention provides a manual, modular, bottom supporting and side containing, shelf allocation and management system 10 for allocating shelf space along a conventional retail store dairy shelf 12 among rows of products 14; for placing new products 14 on the shelf 12; for moving the rows of products 14 or individual products 14 from the rear or back of the shelf 12 toward the front edge of the shelf 12; and for re-setting of the rows of products 14 to alternate positions in the store. The direction of movement is standard in shelf management systems and is generally in line with the depth of and perpendicular to the lateral length of the shelf 12. The system 10 comprises a plurality of adjacent shelf allocating and managing units 20, each unit 20 associated with at least one row of products 14 and freely moveable as a unit relative to the shelf. The term manual within this application and in connection with the system 10 references that only manual movement is used in the system 10, as opposed to spring assisted systems or gravity assisted systems.

The system 10 includes a plurality of adjacent shelf allocating and managing units (also called managing units) 20. Each managing unit 20 will be a multiple piece managing unit 20 the pieces of which can be formed easily as via injection molding. It will be desirable for the managing unit 20 to be formed as an assembly for the purpose of allowing fronting operation and making the managing unit 20 adjustable in some embodiments.

Figure 2A:
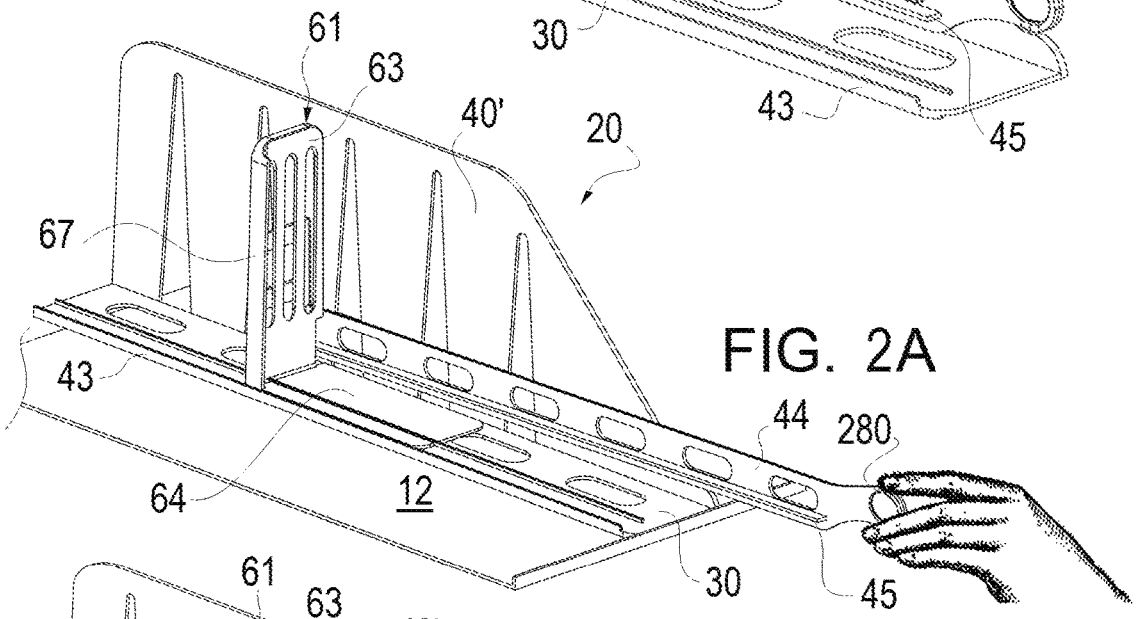
FIG. 2A is a view of the shelf allocation and management unit of FIG. 1 showing the puller and non-tipping back-stop being drawn forward on a shelf with a high front lip.

As shown in FIGS. 1 and 2A, the present invention features a base 30 with integral fixed divider 40' and separate puller 44 where the puller 44 rests on the base 30 and is attached at the rear to integral back-stop 65, which may further be configured to actuate a non-tipping back-stop 61. This system 10 may be referred to as the "Yogurt Embodiment" as it is particularly well suited for such containers. The fixed divider 40' is distinctly different from the dividers 40 of the '527 patent type shelf management system 10, and the free riding puller 44 differs significantly from the back-stop moving elements of the '527 patent type shelf management system 10. This Yogurt Embodiment is a design that allows the row fronting mechanism to be actuated in the case of a shelf with a high front lip 122 which is common on shelves 12 used for yogurt merchandising. Yogurt is among the highest selling areas of a supermarket, so stores dedicate high numbers of man-hours to stocking and fronting the yogurt section, so a yogurt embodiment system 10, which is principally a system 10 designed to allow easier and faster stocking and row fronting, could present significant benefits if installed in the yogurt area.

As shown in FIG. 2A some retail store shelves 12, especially in the dairy section of a supermarket, feature a lip 122 that protrudes upward from the front edge of the shelf 12 and this lip 122 may be approximately 0.35" high but can range from 0.15" to 0.50" high. The Yogurt Embodiment system 10 will feature units 20 with a base 30 and a divider 40' that corresponds in length to the shelf 12 depth. The height of the divider 40' of the Yogurt Embodiment units 20 will generally be between 4.00" and 9.00", with a typical height of 7.00", to provide lateral containment to single-serve yogurt cups which are typically stacked 2-4 high.

Puller 44 is positioned on the inside of divider 40' and immediately adjacent to divider 40' such that puller 44 may be situate alongside and touching divider 40' and will rest on top of and along the length of base 30, but independent thereof, removeable and free riding. As noted above a free riding puller within the meaning of this application defines a puller that is not confined in a channel or guideway making the puller 44 easier to manipulate and can be selectably removable. The removability allows the unit 20, which further includes an open back behind the backstop 65, to be applicable to rear stocking shelves.

Puller 44 runs from the front of the unit 20 to the rear of the unit 20 and features integral backstop 65 which takes the form of prongs that protrudes at approximately a 90 degree angle from the main body of puller 44. The integral backstop 65 attached to the rear of the puller 44 and protruding laterally across the base 30 includes a plurality of openings there through which can be of assistance in refrigerated shelves. In many refrigerated shelves the cooling air moves across the products from the rear of the shelf and a plurality of openings within the back-stop 65 facilitates the cooling of the products and the efficiency of the refrigeration.

Figure 2B:
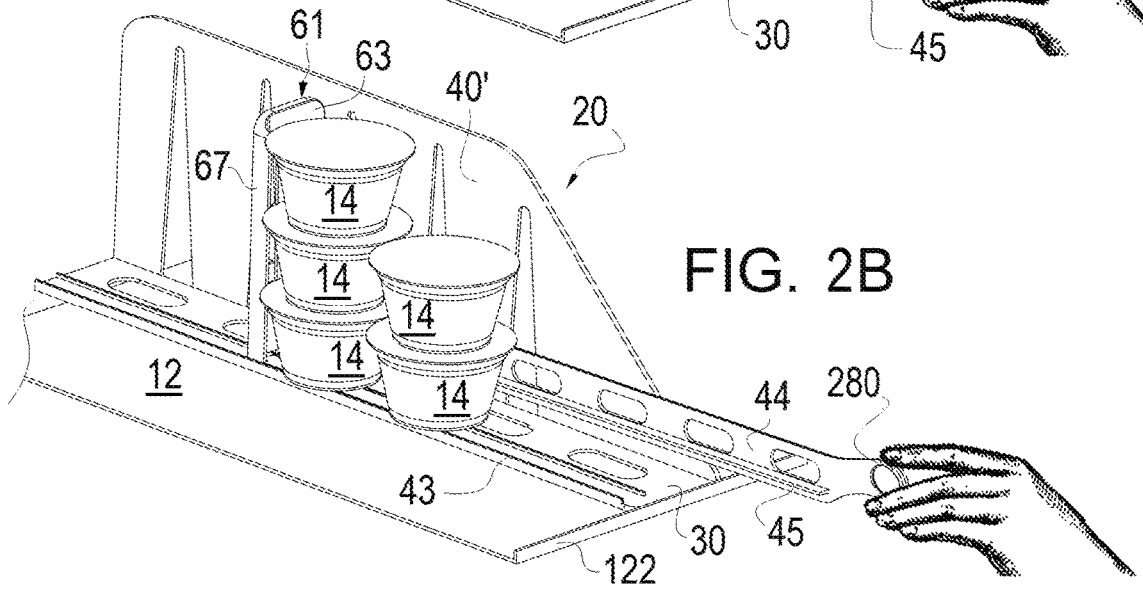
FIG. 2B is a view of the shelf allocation and management unit of FIG. 1 showing product positioned on the unit.

The handle 280 at the front end of puller 44 is configured to be above the base 30 so that it may be easily seen and grasped by an operator. Further, handle 280 is rounded and ergonomically designed to reduce operator fatigue or discomfort when operating puller 44. Puller 44 may take various shapes although, to reduce the lateral profile and provide strength, puller 44 may be shaped as a strip with a rectangular cross section and positioned in the unit 20 on its edge so it assumes a vertical orientation. The body of the puller 44 may be, for example, 1.50" high and 0.125" thick. The puller 44 does not travel through a channel or a track but rather is loose (free riding) and is situated at the inside corner of the unit 20 and rests at the corner presented by the intersection of the base 30 and divider 40'. The puller 44 is restrained neither on the lateral or vertical dimension and therefore, as illustrated in FIGS. 2A and 2B, the front of the puller 44 as well as the puller 44 body may be lifted up and pulled out simultaneously. This "up-and-out" movement allows the puller 44 to easily be lifted clear of a high front lip 122 on a shelf 12 during row fronting (or easily removed for use in rear loading shelves).

Because the puller 44 is not positioned in a channel or track but rather is loose, it is easier both to pull the puller 44 forward as during row fronting and, as importantly, it is easier to return the puller 44 to the normal or starting position. Other shelf allocation and management designs that feature a divider (or dividers) fixed to the base and a separate puller that actuates a back-stop are constrained by the fact that the puller rides in a channel or track and, over time, these channels or tracks may become fouled with spilled product (e.g. yogurt) or a sticky combination of condensation and dust making the operation of the fronting feature and the returning of the puller to the starting position laborious. In some such systems, the puller may become essentially immobile.

A potential disadvantage of a shelf allocation and management unit with a stationary divider 40' and puller 44 is that the puller 44 will, when combined with the thickness of divider 40', may occupy an objectionable amount of lateral space between product 14 rows with the result that fewer rows of merchandise 14 could be displayed for sale. In the categories for which the Yogurt Embodiment system 10 is intended (e.g. single-serve yogurt cups), however, the combined thicknesses of the divider 40' and puller 44 will generally have no effect on the amount of lateral shelf space that may be dedicated to the display of merchandise 14. Some merchandise 14 packages in the dairy section of a typical supermarket when positioned side-by-side present large lateral gaps between one package and the next. Single serve yogurt cups (as well as tubs of sour cream, tubs of cottage cheese, etc.) are either frusto-conical in shape or are inverted frusto-conical shapes which defines a large generally triangular gap 296 between two adjacent yogurt cups 14. As shown in FIG. 12 the large triangular gaps 296 have a "triangle" base width of approximately 0.80" to 1.00" and a "triangle" height of approximately 2.00". The Yogurt Embodiment shelf allocation and management units 20 feature puller 44 that is approximately 1.30" high and so the puller 44 is positioned within the vertical limits of large triangular gap 296. Further, divider 40' has a thickness of approximately 0.10" and puller 44 has a thickness of approximately 0.125" so the combined thickness of divider 40' and puller 44 is approximately 0.225" and therefore exists within the lateral limits of large triangular gap 296.

A second type of gap exists between yogurt cups 14 on the shelf 12 and referenced herein as the rim-to-rim gap 297 as shown in FIG. 12. The rim-to-rim gaps 297 are the gaps that exist between the widest point of the yogurt cups which is usually the top rims of the cups 14 (but may be the bottom rims of the cups for frusto-conical shapes). The rim-to-rim gap 297 is the lateral distance from the widest point of a package in one row to the widest point of a package in an immediately adjacent row. Despite the fact that stores desire to use the full amount of available lateral space on a shelf 12 for displaying products 14, the reality is that rim-to-rim gaps 297 of between approximately 0.10" and 0.20" are present between rows of yogurt cups 14 on a typical dairy shelf 12. The lateral displacement presented by the Yogurt Embodiment units 20 is effectively limited to the thickness of the divider 40' because divider 40' is the only feature of a unit 20 that extends upward and beyond the height of the large triangular gap 296 and so the divider 40' would occupy the space that is normally present in the rim-to-rim gap 297. Because divider 40' is approximately 0.10" thick and the rim-to-rim gap 297 averages approximately 0.15" the installation of yogurt embodiment units 20 on a shelf 12 would typically cause no lateral disruption to the existing product 14 rows.

The system 10 is comprised of a series of shelf management units 20 typically positioned on a shelf 12 immediately adjacent to, and usually touching or in contact with, one another so that merchandise 14 packages positioned on the base 30 of a shelf management unit 20 are contained on the right side by the side divider 40' of the subject unit 20 and are contained on the left side by the side divider 40' of the unit 20 immediately adjacent and to the left. In those cases, however, where a large gap is presented between the subject unit 20 and the unit 20 immediately to the left then the merchandise 14 packages on the subject unit 20 may no longer be contained on the left side and may fall off of the base 30, which is undesirable. A large gap between adjacent units 20 may occur in cases where the merchandise 14 on the left of the subject unit 20 is completely sold out, in the case where units 20 are missing, in a case where a unit 20 is a left-most end unit in a series of units 20, or in a case where, for whatever reason, store management has configured the merchandise 14 on the shelves 12 so that large gaps exist between product rows.

Figure 4A:
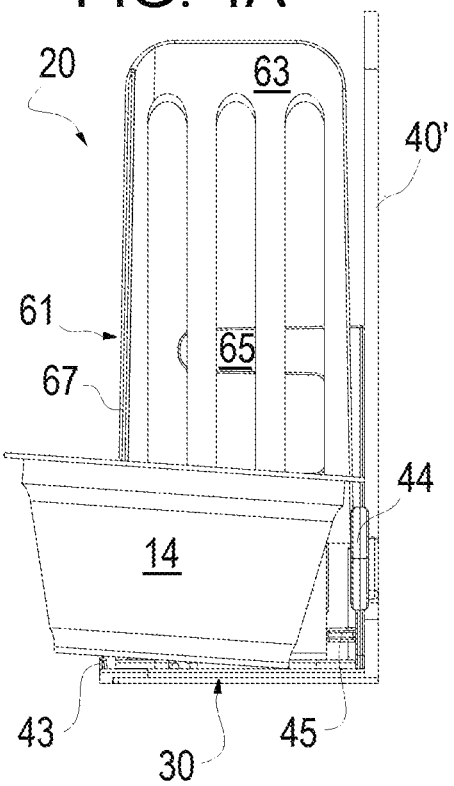
FIG. 4A is a front elevation view of the embodiment of the shelf allocation and management unit shown in FIG. 1 and showing a base that tilts the products in a lateral direction.
Figure 4B:
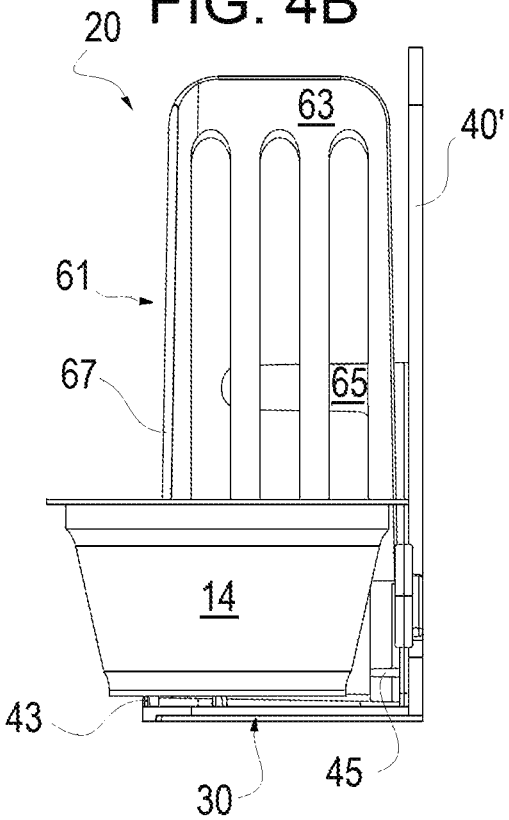
FIG. 4B is a front elevation view of the embodiment of the shelf allocation and management unit shown in FIG. 1 and showing a base that tilts the products in a lateral direction except for the front of the base which is flat.

To address the above-described problem, a further aspect of the present invention, as shown in FIGS. 4A and 4B, provides a laterally inclined base 30 which is formed such that select products are inclined slightly in a lateral direction (at a 90-degree angle in relation to the length of the base 30) so that the force of gravity urges product 14 packages positioned on the base 30 towards the side of the base 30 to which side divider 40' is attached. The incline in the base 30 may be easily formed by having a rail 43 upon which the products rest and which is distal from the divider 40' be slightly higher than any other the rail or product 14 supporting surface closer to the divider 40', with the angle of incline measured between a line (or plane) connecting the tops of the rails or points of contact of the base 30 with the product 14 and the plane of the shelf 12. The amount of incline should be slight and just enough to urge the product 14 away from the open side of the base 30, namely less than 20 degrees and generally 3 to 5 degrees. Additionally if there are more than two rails on the base 30 the height of the intermediate rails should also follow the defined angle of incline such that the tops of all the rails lie in a common plane such that all rails would be used to support the products.

One method for creating the above-described lateral incline is to attach a combination low divider or side rail 43 to the side edge of the base 30 opposite the side to which divider 40' is attached. The combination low divider or side rail 43 would be very low, for example extending upward only 0.25", and would serve a dual purpose. A system 10 could be designed for two product types, as shown schematically in FIG. 14 (which has been simplified to illustrate this concept), in which combination low divider or support rail 43 acts as support rail 43 and defines an incline for one wide product 14 type where the product 14 base is wider than the base 30 whereby a portion of the bottom of the product 14 hangs off the edge of 30 and therefore rests on top of support rail 43. For a smaller diameter (base diameter) of product 14 the entire bottom of the product 14 rests on the base 30 and inside of the combination low divider or support rail 43 and, in this case, combination side divider or support rail 43 acts as side divider 43. In this embodiment the support rails 43 (only one of which is shown in schematic FIG. 14) may not all be along the same line because the rail sets may form distinct inclined angles for the distinct products.

Figure 3:
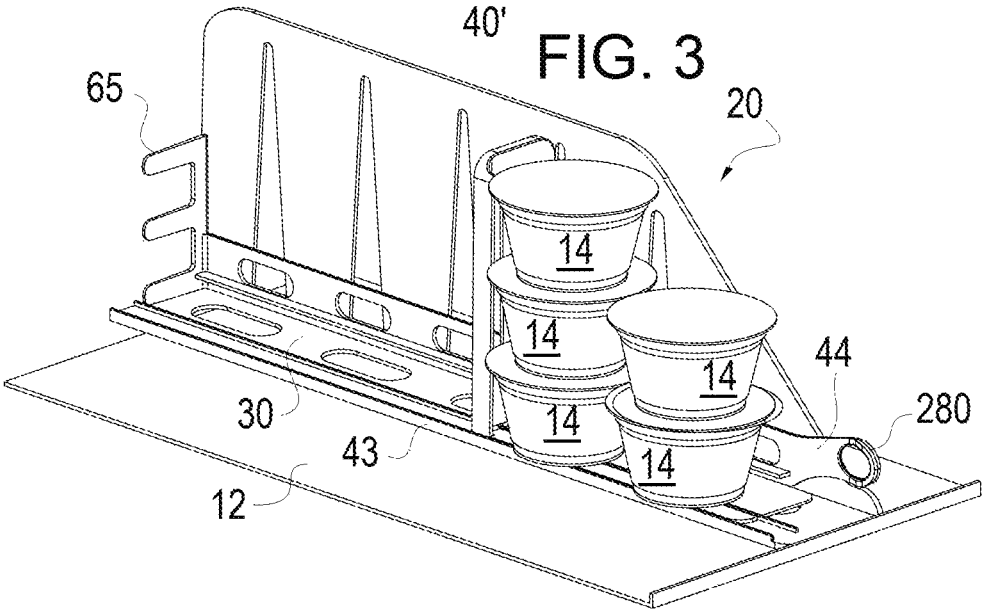
FIG. 3 is a view of the shelf allocation and management unit of FIG. 1 showing the puller returned to the normal position and the non-tipping back-stop supporting product.

As shown in FIG. 4B, in a further embodiment of a laterally inclined base 30, the support rail 43 (or low divider 43) may taper toward the front whereby the defined angle of incline at the front of the base 30 may be reduced so that products 14 positioned at or near the front of the unit 20 will be flat and not tilted and therefore will present a normal appearance to customers. So that products 14 may easily slide along the base 30 from the back of the unit 20 to the front and vice versa without encountering an abrupt change in incline (which might impede the movement of the products 14 along the base 30) the defined angle of incline should be reduced on a gradual taper. For example, products 14 positioned at the middle and rear of the base 30 may be laterally tilted 6 degrees (shown in FIG. 4A) while a product 14 that is 6" rearward of the front of the unit 20 may be tilted at 4 degrees, a product 14 that is 4" rearward of the front may be tilted at 2 degrees and a product 14 at the very front of the unit 20 may be completely flat (0 degrees). Another issue solved by tapering the defined angle of incline to flat towards the front of the unit 20 is that, as shown in FIGS. 1 and 3, Yogurt Embodiment units 20 feature a divider 40' the front of which is swept back at an angle to allow easier consumer view of the products 14 and which design does not provide lateral containment for the product 14 or product 14 stack positioned at the front of the unit 20. Therefore a product 14 stack positioned at the front of the unit 20 may, if the lateral incline is not tapered to flat towards the front of the base 30, tilt so much that the product 14 stack tips over.

As described above, the bottoms of some packages 14 will be wider than the base 30 and some narrower. For those merchandise 14 packages that are wider than the base 30 a small portion of the package 14 (e.g. 0.30") will hang off the edge of the base opposite the side of the base to which the divider 40' is attached. Other merchandise 14 packages will be narrower than the base 30 but typically not more than a small amount (e.g. 0.15"). Because the width of the bottom of most single serve yogurt cups falls within a narrow range (e.g. between 2.60" and 3.00") the Yogurt Embodiment shelf allocation and management unit 20 lends itself to having a base 30 that is of a fixed width (e.g. 2.80"). This single-width "one-size-fits-all" unit 20 is easy to order and install as one size will work with most of the various merchandise 14 packages (e.g. yogurt cups), and, when the assortment is changed or re-set in the future (for example the store eliminates 30 rows of narrower yogurt cups and adds 30 rows of wider cups) the store will not be forced to order more of a new size of units 20 to accommodate the new assortment of products 14 on the shelf 12 because the "one-size-fits-all" units 20 work for most available yogurt cup widths. Therefore, in the example above, the units 20 that were used for the 30 eliminated narrower products 14 may be re-used for the 30 newly-introduced wider products 14.

Figure 6:
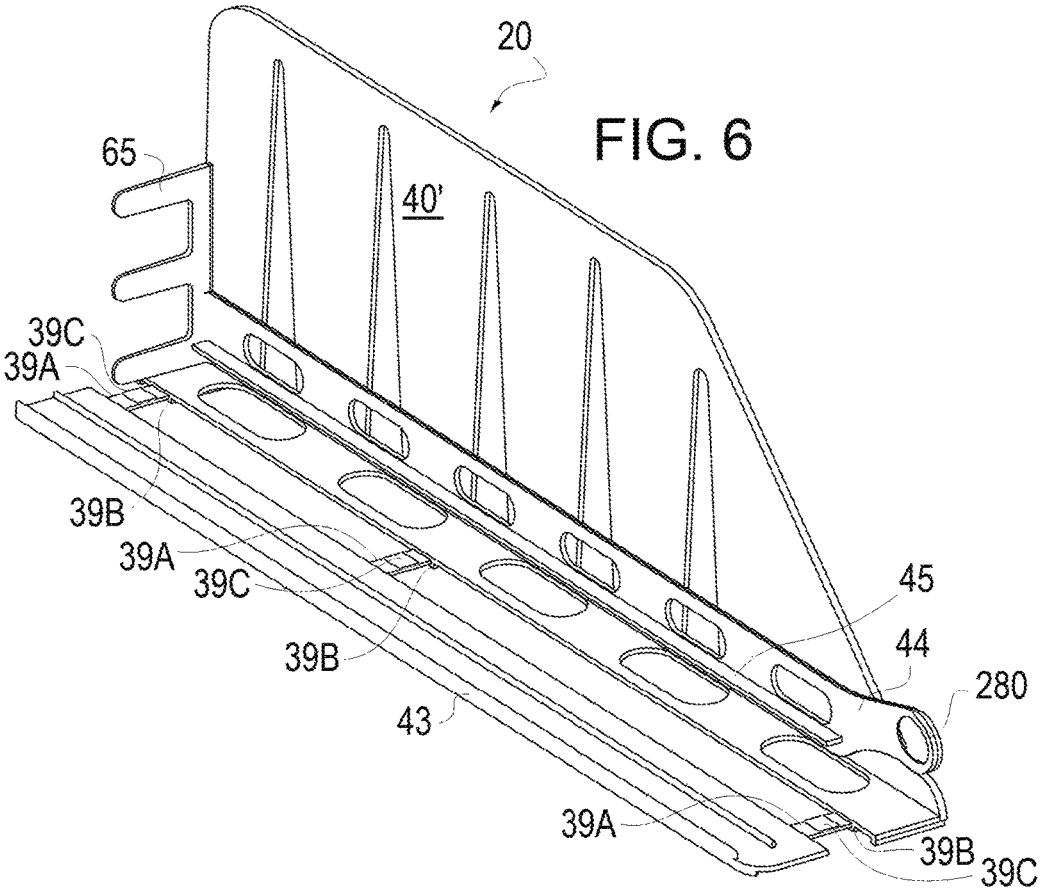
FIG. 6 is a view of a shelf allocation and management unit according to one embodiment of the present invention showing a base that is adjustable in width.
Figure 7:
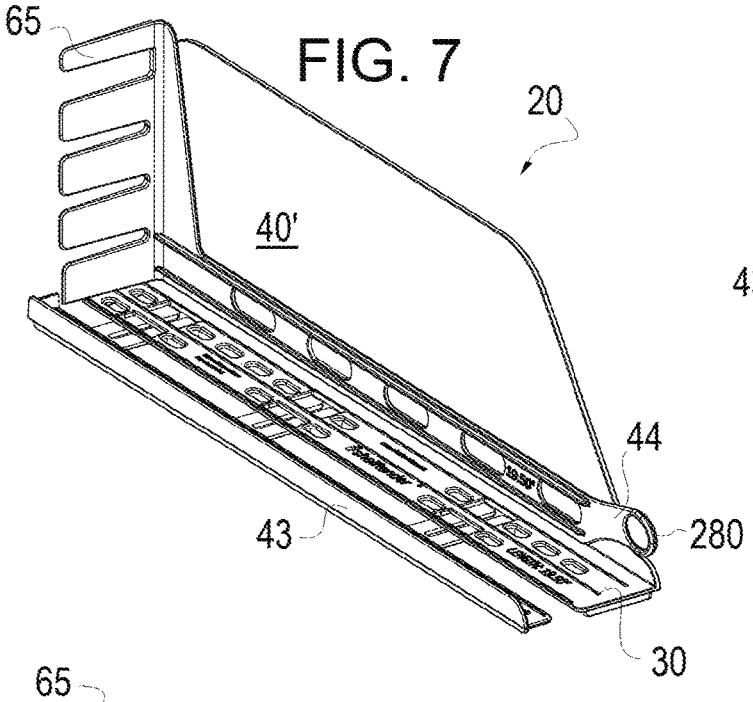
FIG. 7 is a view of a shelf allocation and management unit according to one embodiment of the present invention showing a base that is adjustable in width and an integral back-stop that is high enough to support a high product stack.
Figure 8:
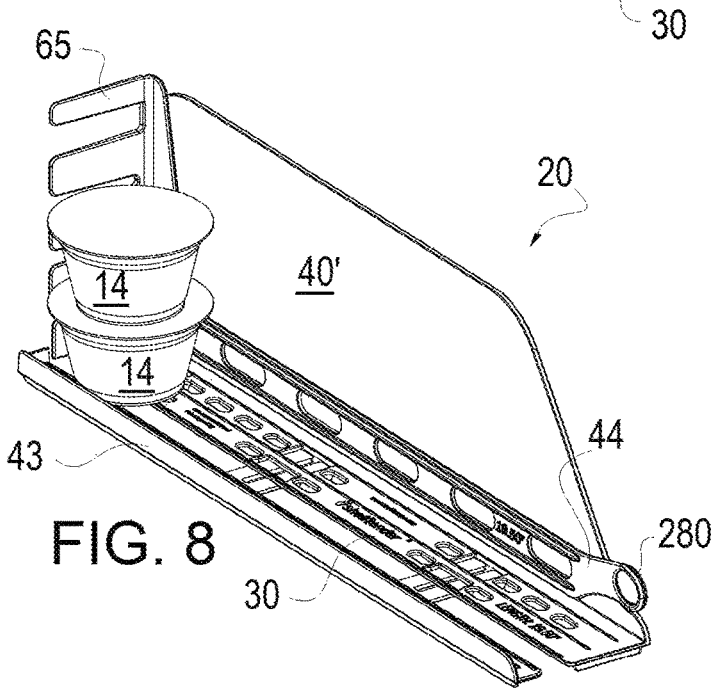
FIG. 8 is a view of shelf allocation and management unit according to FIG. 7 showing product positioned on the unit.
Figure 9:
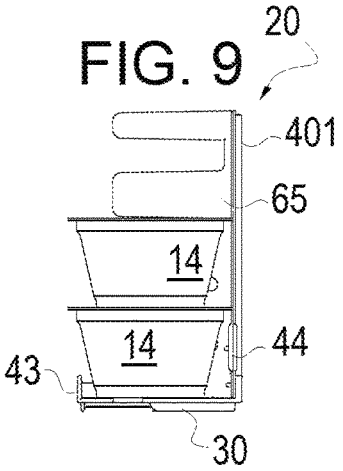
FIG. 9 is a front elevation view of the embodiment of the shelf allocation and management unit shown in FIG. 7 showing a shelf allocation and management unit with a wide product and adjusted to a wide width setting.
Figure 10:
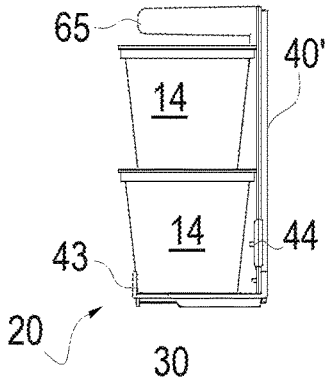
FIG. 10 is a front elevation view of the embodiment of the shelf allocation and management unit showing a shelf allocation and management unit with a narrow product and adjusted to a narrow width setting.
Figure 11:
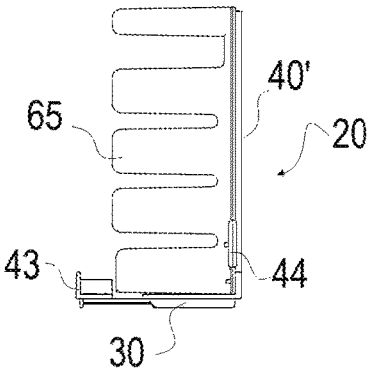
FIG. 11 is a front elevation view of the embodiment of the shelf allocation and management unit shown in FIG. 7.

In a further embodiment, as shown in FIG. 6, the Yogurt Embodiment shelf allocation and management units 20 may also be configured with a base 30 that is adjustable in width to fit merchandise 14 packages of various widths. While the above-described one-size-fits-all single-width unit 20 may be appropriate in stores that carry a modest range of product 14 widths (for example a width range of 2.6" to 3.6"), the rapid introduction by yogurt companies of an ever-increasing variety of package 14 widths may necessitate the use of a width-adjustable unit 20 in stores that carry this very wide range of products 14 where the product 14 widths may range from 2.6" to 4.5". One embodiment of such a width-adjustable unit 20, as shown in FIG. 6, features male protrusions 39A that are inserted, in incremental positions formed by ridges 39C, into corresponding female channels 39B. FIG. 9 shows an adjustable-width unit 20 that is adjusted to a wide position for a wide yogurt cup 14 while FIG. 10 shows the same adjustable width unit 20 but adjusted to a narrow position for a narrow yogurt cup 14.

As shown in FIGS. 7, 8, 9 and 10 a unit 20 that is adjustable in width may, in a further embodiment, also feature a low divider 43 that protrudes upward at a right angle from the side edge of base 30 opposite the side to which divider 40' is attached. This width-adjustable unit 20 would not feature a laterally inclined base (which is mostly useful in keeping products 14 that are wider than base 30 from sliding off the unit 20) but would rather contain the full width of products 14 on the base 30 with the combination of divider 40' and low divider 43. The thickness of low divider 43 would be approximately 0.060" to 0.100". Low divider 43 would be just high enough, for example 0.50", to prevent the bottom of the products 14 from sliding off the base 30. Regarding height of the low divider 43 of the units 20, as noted above a low divider within the meaning of this specification is a divider 1/10" to 3." Preferably a low divider 43 will be 2/10" to 8/10" in height, and most preferably 3/10" to 6/10" in height. So, in this width-adjustable embodiment, low divider 43 is low enough to allow products 14 to easily be placed on the base 30 from the side of the unit 20 enabling store clerks to practice proper stock rotation by placing new products 14 at the rear of an existing row of products 14 in a unit 20. Because the units 20 are not attached to the shelf 12 the store clerk may easily pull the entire unit 20 forward and outward exposing the open side of the unit 20 so that new yogurt cups 14 can easily be placed in the unit 20 from the side, and this method is faster than if the store clerk is required to perform this stocking and rotation function from the front of the unit 20 in which case all of the existing products 14 must be removed from unit 20 and then new products 14 placed at the rear of unit 20, and then, finally, the existing products 14 placed at the front of unit 20. If low divider 43 were much higher (for example, 7" high) then a unit 20 would have two tall dividers, and in this case the preferred method of stocking from the side of the unit would no longer be feasible.

As shown in FIG. 13, when two width-adjustable Yogurt Embodiment shelf allocation and management units 20 featuring low divider 43 are positioned side-by-side the combined thickness of puller 44 (approximately 0.125"), divider 40' (approximately 0.10") of the subject unit 20 and the thickness of low divider 43 (approximately 0.10") of a unit 20 immediately adjacent and to the right totals 0.325" and so this combined thickness is less than the width of large triangular gap 296 (0.80" to 1.00") that naturally exists between rows of single-serve yogurt cups 14. As low divider 43 is approximately 0.50" high it does not extend higher than large triangular gap 296. Therefore the installation of a series of units 20 (on shelves 12 merchandising single-serve yogurt cups 14) featuring both divider 40' and low divider 43 as well as puller 44 will not cause lateral disruption to the product 14 rows.

Figure 5:
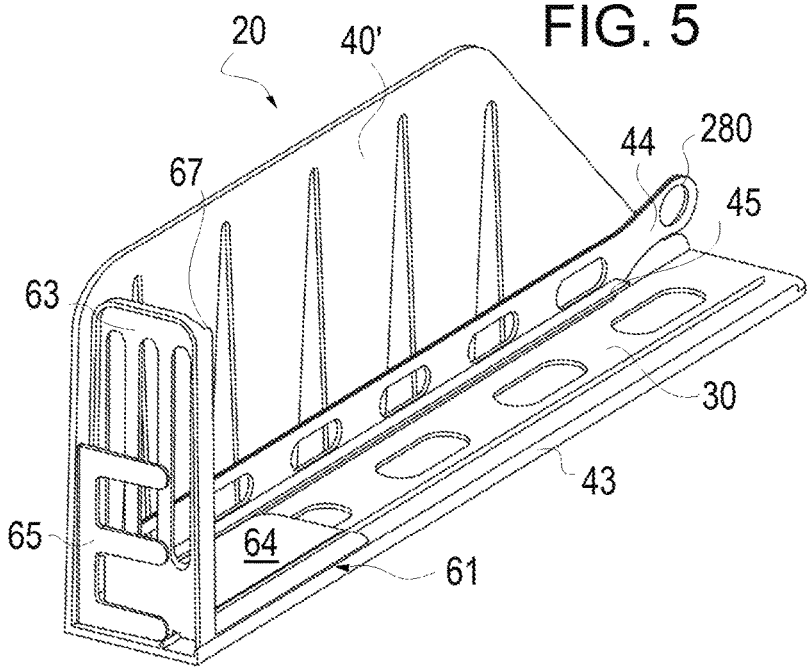
FIG. 5 is a view of the rear of a shelf allocation and management unit according to one embodiment of the present invention showing an integral backstop positioned behind and configured to actuate a non-tipping backstop.

A further aspect of the present invention, as shown in FIGS. 3 and 5, is a non-tipping backstop 61 configured to prevent merchandise 14 with a high center of gravity in a unit 20 from tipping backwards. Integral backstop 65 may be positioned on the unit 20 behind non-tipping back-stop 61 and is configured to contact non-tipping backstop 61 such that when puller 44 is pulled forward integral backstop 65 also comes forward which, in turn, brings non-tipping backstop 61, and all merchandise 14 on the unit 20, forward. If merchandise 14 in a unit 20 tips or falls over backwards then the store clerk must remove all of the standing merchandise 14 from the unit 20, retrieve and re-position the tipped merchandise 14 and finally replace the previously standing merchandise 14 back on the unit 20. This is a time-consuming process and should be eliminated. Many types of merchandise 14 have a low center of gravity (e.g. pasta sauce jars) and, as these types of packages rarely tip over backwards, integral backstop 65 of a unit 20 will suffice. Some types of merchandise 14, however, have a high center of gravity and are therefore prone to tipping over. This includes, for example, tall air freshener cans and tall spray paint cans. Also prone to tipping are merchandise 14 items that are stacked two-high, three-high or greater. This type of merchandise 14 stacking is often seen, for example, with single-serve yogurt cups and baby food jars. Despite the advantages presented with the use of non-tipping back-stop 61, for the sake of simplicity it may be preferable in some cases to not use non-tipping back-stop 61 and instead use a variant of integral back-stop 65, as shown in FIGS. 7, 8, 9, 10 and 11, that is raised in height to be approximately as high as fixed divider 40' (e.g. 7") and therefore provides support to a product 14 stack at least during row fronting.

The non-tipping backstop 61 is used in conjunction with a unit 20 with integral backstop 65. As shown in FIGS. 1 and 5, the non-tipping backstop 61 is shaped like an "L" and features a rear plate 63 and a tongue 64. The rear plate 63, which in most cases will be from 6" to 8" high, is attached to a tongue 64 that rests on the base 30 and protrudes forward of the rear plate 63 a distance approximately equal to the height of the rear plate 63, or approximately 7". As shown in FIG. 3, the tongue 64 is configured so that at least two individual pieces of merchandise 14 or two stacks of merchandise 14 may be positioned on top of the tongue 64 immediately forward of (ideally touching) the rear plate 63 thereby providing weight that stabilizes the rear plate 63 of the non-tipping backstop 61. When merchandise 14 is positioned on top of the tongue 64 in this manner then the center of gravity of this collection of merchandise 14 positioned on the non-tipping backstop 61 is significantly lower than it would be were that same merchandise 14 not resting on the non-tipping backstop 61, and therefore this merchandise 14 is significantly less prone to tipping over backwards.

As shown in FIGS. 1 and 2A, puller 44 may feature a ledge 45 (or reinforcing ridge or rib) which runs along the length of puller 44 and protrudes on a perpendicular plane approximately 0.30" from the inside face of puller 44 (which is the side of puller 44 that faces the side the unit 20 opposite the side to which divider 40' is attached). One purpose of ledge 45 is to prevent non-tipping back-stop 61 from tipping backwards. In the event that non-tipping back-stop 61 began to tip backwards, tongue 64 would begin to rise upward but would, after rising just a few degrees, make arresting contact with ledge 45 and therefore tongue 64 would be prevented from rising any further and non-tipping backstop 61, then, would be prevented from tipping over backwards. Rear plate 63 of non-tipping back-stop 61 features a notch which allows ledge 45 to pass through. Ledge 45 also serves as a rib or ridge to impart rigidity to puller 44 so that, especially when it is returned to the normal position after row fronting, puller 44 is less likely to bend.

The non-tipping backstop 61 is not attached to the back-stop 65 or to puller 44 or to the base 30. Rather the non-tipping backstop 61 slides freely forward and backward along the top of the base 30. The non-tipping backstop 61 includes opening therethrough that allows refrigerated air to move from the back of the shelf 12 over the products similar to the design of the backstop 65. Backstop 65 prevents merchandise 14 from falling off the rear of the base 30 and also pushes merchandise 14 forward when puller 44 is drawn forward during row fronting. Because the default or storage position of backstop 65 is at the rear of the shelf 12, backstop 65 provides no support to merchandise 14 positioned in the middle or towards the front of base 30. For example, for a unit 20 without a non-tipping back-stop 61, when puller 44 and integral backstop 65 of a unit 20 is in the storage position (at the rear) and if single-serve yogurt cups are stacked three-high on a unit 20 and if a ten-inch gap exists between integral backstop 65 and the rearmost stack of yogurt cups on the base 30 then the rearmost stack of yogurt cups will be prone to tipping over backwards when a store clerk adds new yogurt cups to the front of the unit 20. Tipping may also occur when the front of the row of yogurt cups 14 is bumped as could occur when a shopper selects a yogurt cup 14 for purchase. The non-tipping backstop 61 travels with and supports the rearmost pieces of merchandise 14 (or rearmost merchandise 14 stack) thereby preventing the merchandise 14 from tipping backwards regardless of how full is the row of merchandise 14 in a unit 20.

The non-tipping backstop 61 may in some embodiments feature a coupling mechanism integral to the underside of tongue 64 and corresponding features on the top of base 30 (or laterally inclined base 30) where the coupling mechanism would provide lateral stability to the non-tipping backstop 61 such that it would be prevented from moving sideways and would be prevented from tipping backward or forward, yet would freely slide backwards and forwards along the top of base 30 (or laterally inclined base 30) of a unit 20.

It is understood, therefore, that this invention is not limited to the particular embodiments disclosed, but it is intended to cover modifications that are within the spirit and scope of the invention, as defined by the appended claims and equivalents thereto.

What is claimed is:

1. A bottom supporting shelf allocation and management system for allocating shelf space among rows of products, the system comprises:

a plurality of adjacent shelf allocating and managing units, each unit associated with at least one row of products, wherein each unit includes:

a base adapted to rest on a shelf and to support the at least one row of products;

a perpendicular side divider fixedly attached to a side edge of the base;

a puller positioned immediately adjacent to the divider and immediately adjacent to a top of the base, and a back-stop attached to the rear of the puller and protruding laterally across the base which is configured, when the puller is drawn forward, to make contact with a rearmost product resting on the base and to push the rearmost product and any other products on the base forward with the forward movement of the puller.

2. The bottom supporting shelf allocation and management system for allocating shelf space among rows of products according to claim 1 further including a base that is adjustable in width.

3. The bottom supporting shelf allocation and management system for allocating shelf space among rows of products according to claim 1 further including a perpendicular low side divider fixedly attached to a side edge of the base extending to a height of 1/10" to 3".

4. The bottom supporting shelf allocation and management system for allocating shelf space among rows of products according to claim 1 further including a product supporting surface of each base whereby select products supported on the product supporting surface of the base are configured to be inclined in a lateral direction and towards the divider of the shelf management unit.

5. A bottom supporting shelf allocation and management system for allocating shelf space among rows of products, the system comprises:

a plurality of adjacent shelf allocating and managing units, each unit associated with at least one row of products, wherein each unit includes:

a base adapted to rest on a shelf and to support the at least one row of products;

a perpendicular side divider fixedly attached to a side edge of the base;

a puller positioned immediately adjacent to the divider and immediately adjacent to a top of the base, and a back-stop attached to the rear of the puller and protruding laterally across the base which is configured, when the puller is drawn forward, to make contact with a rearmost product resting on the base and to push the rearmost product and any other products on the base forward with the forward movement of the puller further including a product supporting surface of each base whereby select products supported on the product supporting surface of the base are configured to be inclined in a lateral direction and towards the divider of the shelf management unit, wherein the product supporting surface of each base tapers toward a front of the unit wherein select products supported on the product supporting surface of the base on or in front of the tapered portion are configured to be inclined in a lateral direction and towards the divider of the shelf management unit at less of an incline angle than select products supported on the product supporting surface of the base rearward of the tapered portion.

6. The bottom supporting shelf allocation and management system for allocating shelf space among rows of products according to claim 1 further including a laterally protruding ledge on the puller.

7. The bottom supporting shelf allocation and management system for allocating shelf space among rows of products according to claim 1 wherein the back-stop attached to the rear of the puller and protruding laterally across the base includes a plurality of openings there through.

8. The bottom supporting shelf allocation and management system for allocating shelf space among rows of products according to claim 1 wherein the puller is a removeable free riding unconstrained puller.

9. The bottom supporting shelf allocation and management system for allocating shelf space among rows of products according to claim 1 wherein the puller includes a rounded handle raised above the base.

10. The bottom supporting shelf allocation and management system for allocating shelf space among rows of products according to claim 1 further including a non-tipping backstop configured to provide constant support to the rearmost product such that the product is prevented from falling over backwards regardless of the position of the rearmost product on the base.

11. The bottom supporting shelf allocation and management system for allocating shelf space among rows of products according to claim 1 wherein the side divider includes a tapered forward edge.

12. The bottom supporting shelf allocation and management system for allocating shelf space among rows of products according to claim 1 further including an open back behind the backstop.

13. A bottom supporting shelf allocation and management unit for allocating shelf space among rows of products, the unit associated with at least one row of products, wherein the unit comprises:

a base adapted to rest on a shelf and to support the at least one row of products;

a perpendicular side divider fixedly attached to a side edge of the base;

a puller positioned immediately adjacent to the divider and immediately adjacent to a top of the base, and a back-stop attached to the rear of the puller and protruding laterally across the base which is configured, when the puller is drawn forward, to make contact with a rearmost product resting on the base and to push the rearmost product and any other products on the base forward with the forward movement of the puller.

14. The bottom supporting shelf allocation and management unit for allocating shelf space among rows of products according to claim 13 further including a perpendicular low side divider fixedly attached to a side edge of the base extending to a height of 1/10" to 3".

15. The bottom supporting shelf allocation and management unit for allocating shelf space among rows of products according to claim 14 wherein the perpendicular low side divider fixedly attached to a side edge of the base extends to a height of 2/10" to 8/10".

16. The bottom supporting shelf allocation and management unit for allocating shelf space among rows of products according to claim 14 wherein the base is adjustable in width.

17. The bottom supporting shelf allocation and management unit for allocating shelf space among rows of products according to claim 14 wherein the low-height side divider provides lateral containment for narrower products where the bottoms of the narrower products are smaller in width than the width of the base, and imparts a lateral tilt to wider products that extend over the edge of the base.

18. The bottom supporting shelf allocation and management unit for allocating shelf space among rows of products according to claim 14 wherein the back-stop attached to the rear of the puller and protruding laterally across the base includes a plurality of openings there through.

19. The bottom supporting shelf allocation and management unit for allocating shelf space among rows of products according to claim 14 wherein the puller is a removeable free riding unconstrained puller.

20. The bottom supporting shelf allocation and management unit for allocating shelf space among rows of products according to claim 14 further including a non-tipping back-stop configured to provide constant support to the rearmost product such that the product is prevented from falling over backwards regardless of the position of the rearmost product on the base.

* * * * *